US006283439B1

(12) United States Patent
Myers et al.

(10) Patent No.: US 6,283,439 B1
(45) Date of Patent: Sep. 4, 2001

(54) WALL FORM PANEL AND METHOD OF MAKING THE SAME

(75) Inventors: Dallas E. Myers, Middletown, OH (US); Norman Cottongim, Richwood Hill, GA (US); Floyd P. Johnson, Middletown, OH (US)

(73) Assignee: Feather Lite Innovations, Inc., Springboro, OH (US)

( * ) Notice: Subject to any disclaimer, the term of this patent is extended or adjusted under 35 U.S.C. 154(b) by 0 days.

(21) Appl. No.: 09/232,414

(22) Filed: Jan. 15, 1999

Related U.S. Application Data

(60) Provisional application No. 60/071,758, filed on Jan. 16, 1998.

(51) Int. Cl.[7] ..... E04G 11/00

(52) U.S. Cl. ..... 249/45; 249/47; 249/191; 249/196; 29/428

(58) Field of Search ..... 249/47, 33, 44, 249/45, 191, 192, 196, 428, 469

(56) References Cited

U.S. PATENT DOCUMENTS

| | | | | |
|---|---|---|---|---|
| 2,750,647 | | 6/1956 | Krieg . | |
| 3,074,141 | | 1/1963 | Bowden et al. . | |
| 3,168,772 | | 2/1965 | Williams . | |
| 3,327,986 | | 6/1967 | Oury . | |
| 3,477,684 | | 11/1969 | Dagiel . | |
| 3,661,354 | | 5/1972 | Dagiel et al. . | |
| 3,734,451 | * | 5/1973 | Tierney | 249/47 |
| 3,785,610 | | 1/1974 | Dagiel . | |
| 4,027,846 | | 6/1977 | Caplat . | |
| 4,030,694 | | 6/1977 | Schimmel . | |
| 4,070,845 | | 1/1978 | Cody . | |
| 4,150,808 | | 4/1979 | Sawyer . | |
| 4,239,173 | | 12/1980 | Sawyer . | |
| 5,098,059 | | 3/1992 | Sawyer . | |
| 5,102,092 | * | 4/1992 | Salas | 249/47 |
| 5,174,909 | * | 12/1992 | Ward | 249/47 |
| 5,184,439 | | 2/1993 | Ward . | |
| 5,651,910 | | 7/1997 | Myers et al. . | |
| 5,833,873 | * | 11/1998 | Adonetti | 249/47 |
| 5,922,236 | * | 7/1999 | Zuhl | 249/47 |

* cited by examiner

*Primary Examiner*—Michael Safavi
(74) *Attorney, Agent, or Firm*—Wood, Herron & Evans, L.L.P.

(57) ABSTRACT

A wall form panel for use in constructing a poured concrete wall form is preferably extruded from aluminum and a plurality of sections which are joined together form the wall form panel. The outer side most sections of the wall form panel advantageously include integrally formed and extruded side flanges to provide enhanced load-bearing capability and reduce the likelihood of failure. The extruded panel sections are coupled together along longitudinally extending joint members and reinforced beams and struts are welded to the back face of the wall panel sections for added strength and rigidity. Advantageously, the wall form panel sections can be formed in a plurality of widths and joined together in various combinations to conveniently provide a variety of widths of wall form panels. The side flanges of the wall form panels includes holes for attaching pins and other associated hardware. Advantageously, a reinforced bushing is seated within the flange to provide increased strength and avoid material failure in this location.

16 Claims, 3 Drawing Sheets

6
6
38
34
18
60
40
24
10
36

14
41
45
43
26

WALL FORM PANEL AND METHOD OF MAKING THE SAME

This claims the benefit of U.S. Provisional Patent Application Ser. No. 60/071,758, filed Jan. 16, 1998 and hereby incorporated by reference in its entirety.

BACKGROUND OF THE INVENTION

This invention relates to a poured concrete wall form panel and, more particularly, to a method of making such a panel.

It is well known in the art to use prefabricated and reusable panel units to construct a wall form for a poured concrete wall. Typically, each panel has a marginal frame welded to an projecting rearwardly from a back face of the panel to include a flange along the spaced side edges of the panel. The flanges are adapted to be positioned in face-to-face relationship with the flange of an adjacent panel to construct a concrete wall form. Holes in the flanges of the adjacent panels can be aligned to receive therethrough the shank of a pin or a bolt. A pair of spaced concrete wall forms are assembled and liquid concrete is poured between the wall forms and allowed to cure or harden thereby forming a poured concrete wall. Once the wall has cured, the concrete wall forms and associated hardware are disassembled for transportation to another job site and reuse.

In the construction of a concrete wall form, a large quantity of panels is necessary to construct the appropriately sized and configured poured concrete wall. Typically, the individual panels used to construct the wall forms are 7' or 8' in height and 2' or more in width. Panels which are less than 12" in width are typically called fillers. It will be appreciated that a variety of panel sizes, configuration and dimensions is required to appropriately construct a wall form for the various poured concrete wall configurations which are required in modern construction designs.

Currently, wall form panels are manufactured by welding a perimeter frame to the rear face of a generally planar panel. The welded connection between what becomes the rearwardly extending flanges on the wall form panels and the front planar face of the panel is subjected to very high stresses and hydrodynamic forces as a result of the poured concrete between the wall forms. Therefore, the welded connection between the rearwardly extending frames/flanges and the panels weaken or fail in use. The stresses are particularly accentuated along the side edge flanges of the wall form panel because that is the location of the connection between the adjacent panels and the concentration of the forces exerted by the poured concrete on the wall panels.

The concrete poured between the assembled forms acts substantially like a fluid and delivers significant hydrostatic pressures to the wall panels he forms. Typically, the compressive load on a concrete form 8' high can easily reach 1,000 to 1,200 pounds per square foot. The panel, connection hardware and assembled wall form must be able to withstand these pressures without buckling, deformation or failure.

For this reason, known panels can be quite heavy, typically each weighing about 90 pounds or more. Usually a single worker manipulates the panels and moves them around on the job site. Therefore, a lighter weight panel would not only reduce material and shipping costs, but increase labor productivity while minimizing potential injuries to the workers who handle the panels. However, lighter panels typically suffer from the problem of providing insufficient strength or structural integrity to the assembled wall form.

One solution to these problems with respect to wall form panels is disclosed in U.S. Pat. No. 5,651,910 issued to Myers et al. on a concrete wall form and tie system, the disclosure of which is incorporated herein by reference in its entirety.

SUMMARY OF THE INVENTION

Therefore, there is a need in the poured concrete wall industry for an improved wall form panel design which is both light weight and sturdy while being manufactured in an economical manner. Furthermore, the wall form panel should be easily configurable and compatible for a variety of configurations and size requirements to accommodate various poured concrete wall configurations and designs.

The present invention attains these and other objectives through a new wall form panel and method of making such a wall form panel. Advantageously, the wall form panel is preferably extruded from aluminum in sections and complementary extruded sections are joined together to form individual wall form panels. Depending on the sizes of the various extruded wall form sections which are joined together, a wide variety of wall form panel widths according to this invention can be constructed.

Currently, extruding technology limits the maximum available width of extruded members to 12" to 14". However, according to the present invention, extruded wall form panels having widths up to 36" or greater can be constructed of the appropriately extruded wall form panel sections. Preferably, the wall form panels according to this invention are manufactured in 8' heights thereby minimizing, if not eliminating, the need for additional filler panels positioned atop standard 7' high panels for constructing 8' high poured concrete walls or the like.

In a presently preferred embodiment of this invention, a method of making a wall form panel for use in constructing a poured concrete wall includes extruding from aluminum a first and a second panel section, each having a generally planar front face and an integrally formed side flange projecting rearwardly from a back face of each panel section. The integrally formed side flange extends longitudinally along an outer side edge of each section. Each panel section also has a joint member on an inner longitudinal side edge thereof. A width of each panel section is less than the overall width of the wall form panel and the first and second panels are preferably mirror images of one another with the possible exception of the configuration of the joint member.

A plurality of spaced holes are preferably formed in the side flanges of the first and second panels and a bushing is installed in each of the holes in the flanges.

Depending upon the width of the panel being constructed, an interior panel section may be extruded from aluminum having longitudinal spaced side edges, a generally planar front face and a joint member on each of the longitudinally spaced side edges. The first, second and interior panel sections are then joined together at the mating joint members with the interior panel section intermediate the first and second panel sections. Preferably, the joint members are tongue and groove or a similar configuration and are then welded or glued together to permanently join the panel sections. Additional reinforcing members such as laterally extending struts and longitudinally extending beams are preferably welded or glued to the back face of the joined panel sections for added strength and rigidity.

The juncture between the front sheet and the rearwardly extending flanges, up until this invention, has been readily recognized in the industry as a high failure area for poured concrete wall panels due to the forces exerted on the panels from the poured concrete and the associated connection hardware between the adjacent panels. Advantageously, the side flange of the wall form panel in this invention is integrally formed with the panel section thereby strengthening the juncture between the front panel and the rearwardly extending flange in comparison with known side flanges which are welded to the front panel face.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figures 1, 2:
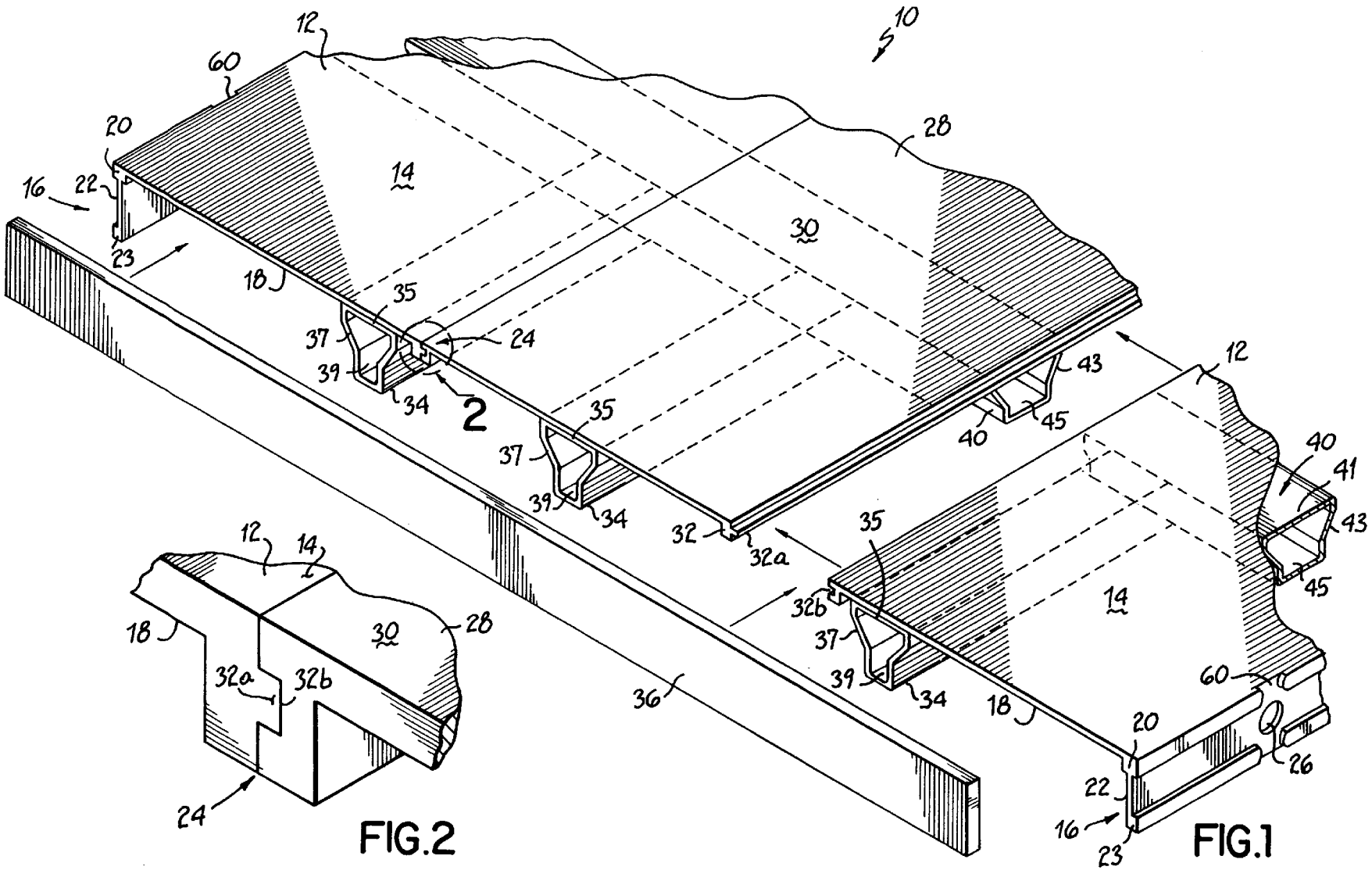
FIG. 1 is a partially disassembled partial perspective view of a presently preferred embodiment of a wall form panel according to this invention.
FIG. 2 is an enlarged perspective view of adjacent panel sections of the wall form panel of FIG. 1 at the joint between those sections.

Referring to FIG. 1, a presently preferred embodiment of a poured concrete wall form panel 10 according to this invention is shown. The wall form panel 10 includes first and second panel sections 12 which are extruded preferably from aluminum or another appropriate material. Each panel section 12 has a generally planar front face 14 and an integrally formed side flange 16 projecting rearwardly from a back face 18 of each panel section 12. A cross-sectional profile of each side flange 16 reveals that the side flange has a lower base section 20 joined by a connecting web 22 to an upper rib 23. The integrally formed side flange 16 extends longitudinally along an outer side edge of the panel section 12. Extending longitudinally along an inner side edge of the panel section is a joint 24. In a presently preferred embodiment, the joint 24 as shown particularly in FIG. 2 is a tongue and groove mating configuration. The lateral width of each panel section 12 is less than the overall width of the resulting wall form panel 10.

The side flange 16 of each panel section 12 includes a plurality of spaced holes 26 preferably at approximately 12" intervals beginning at 6" from a longitudinal top and bottom edge of the panel section 12. In one presently preferred embodiment of this invention, each panel section 12 is extruded into approximately 12" width sections. For a wall panel 10 having a width of 24", the first and second panel sections 12 are joined directly together to form the 24" wide panel 10. For panels 10 of widths wider than 24", an interior panel section 28 having a generally planar front face 30 and complementary joint members 32 extending along lateral side edges thereof is used. The lateral width of the interior panel section 28 for a 36" wide panel 10 is 12" to complement the 12" wide first and second panel sections 12. It will be appreciated by one of ordinary skill in the art that the width dimensions of the panels are exemplary only and should not be considered as a limitation upon this invention. The interior panel section or sections 28 are preferably extruded from aluminum or another appropriate material.

Figures 5, 6:
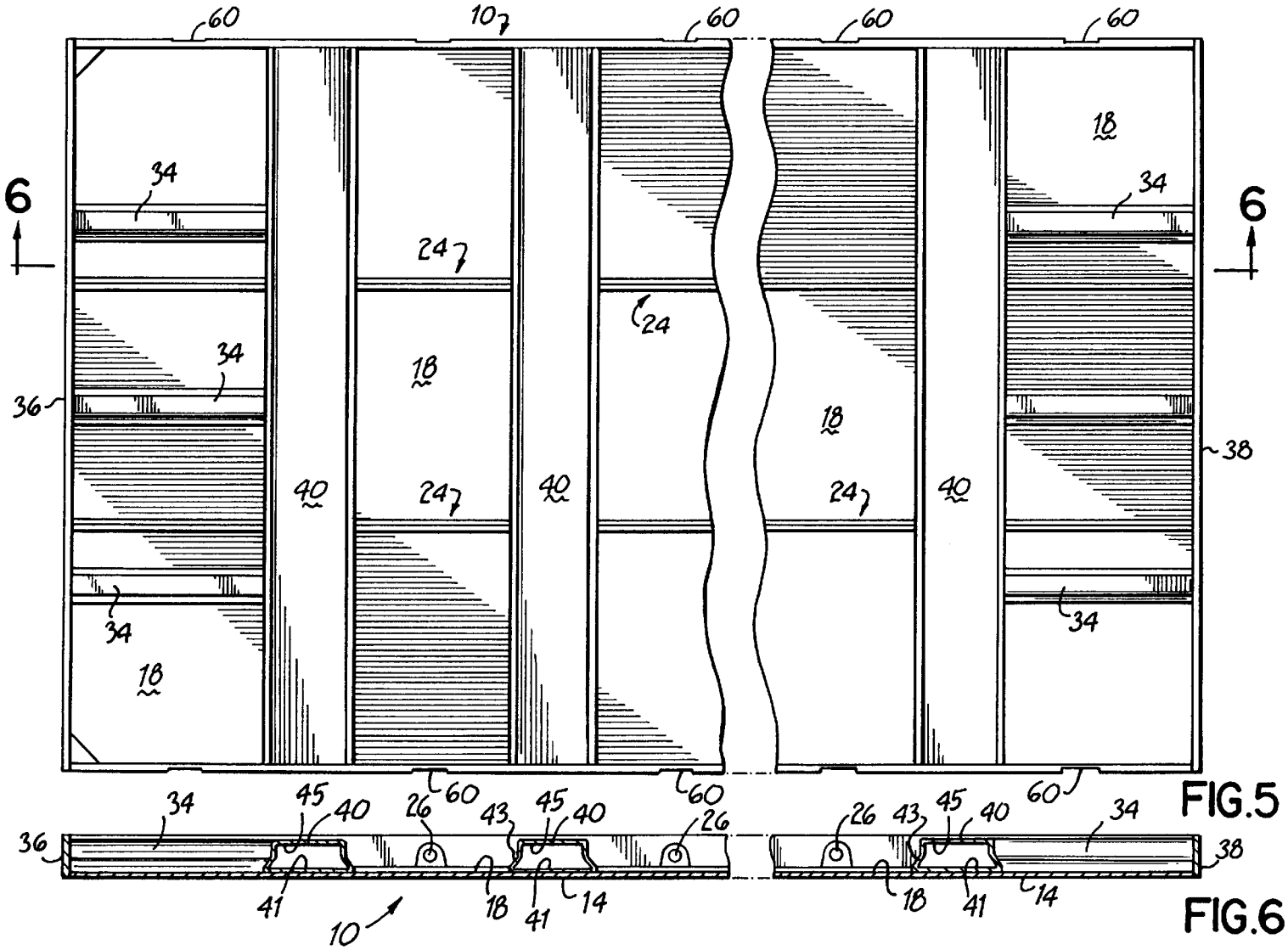
FIG. 5 is a rear face plan view of a wall form panel according to a presently preferred embodiment of this invention.
FIG. 6 is a cross-sectional view taken along line 6—6 of FIG. 5.

Referring to FIGS. 1 and 5–6, each of the panel sections 12, 28 and the resulting panels 10 formed from those sections includes reinforcing members on the back face of the joined panel sections 12, 28. Preferably, longitudinally extending beams 34 having a cross-hat shaped cross-sectional configuration with a wider base 35 adjacent the back face of the panel sections and a tapered section 37 joined to a generally U-shaped upper section 39. The beams 34 are welded, glued or otherwise adhered to the back face of the panel sections 12, 28. Top and bottom flange 36, 38 extending the width of the panel 10 spanning each of the individual panel sections 12, 28 are preferably welded, glued, joined or integrally formed with/to the joined panel sections 12, 28 along top and bottom edges thereof, respectively.

Laterally extending struts 40 preferably having a cross-hat shaped configuration with a wider base 41 adjacent the back face of the panel sections 12, 28 and a tapered section 43 joined to a generally U-shaped upper section 45. The struts 40 are also welded, glued, joined or integrally formed with/to the back face of the joined panel sections 12, 28. The struts 40 extend preferably the entire width of the panel 10 from side flange 16 of the first section 12 to side flange 16 the second section 12. Preferably, the longitudinally extending beams 34 extend from the top flange 36 to the uppermost strut 40 and from the bottom flange 38 to the lowermost strut 40 to provide enhanced strength and reinforcement to the upper and lowermost regions of the panel 10. The section of the panel 10 which typically experiences the highest loads is the bottom and as a result of the location of the beams 34, the panel 10 is interchangeable from top to bottom for easier installation and use.

Referring to FIG. 2, a presently preferred embodiment of the joint formed by the joint members 32 between the panel sections 12, 28 is shown. The joint members include a tongue 32*a* which extends preferably the entire height of the panel section 12, 28 and a mating groove 32*b* which likewise extends the entire height of the panel sections 12, 28. Each of the first and second panel sections 12 includes either the tongue 32*a* or the groove 32*b* on the lateral side edge thereof opposite from the flange 16. The interior panel section 28 preferably includes the tongue 32*a* on a lateral side edge and the groove 32*b* on the opposite lateral side edge thereof. After the mating joint members 32 are joined together, they are preferably welded, glued or otherwise bonded together. It will be appreciated that the tongue 32*a* and groove 32*b* configuration is presently preferred, although other arrangements, mechanisms, means or the like could be used to join the panel sections 12, 28 together within the scope of this invention.

Figure 3:
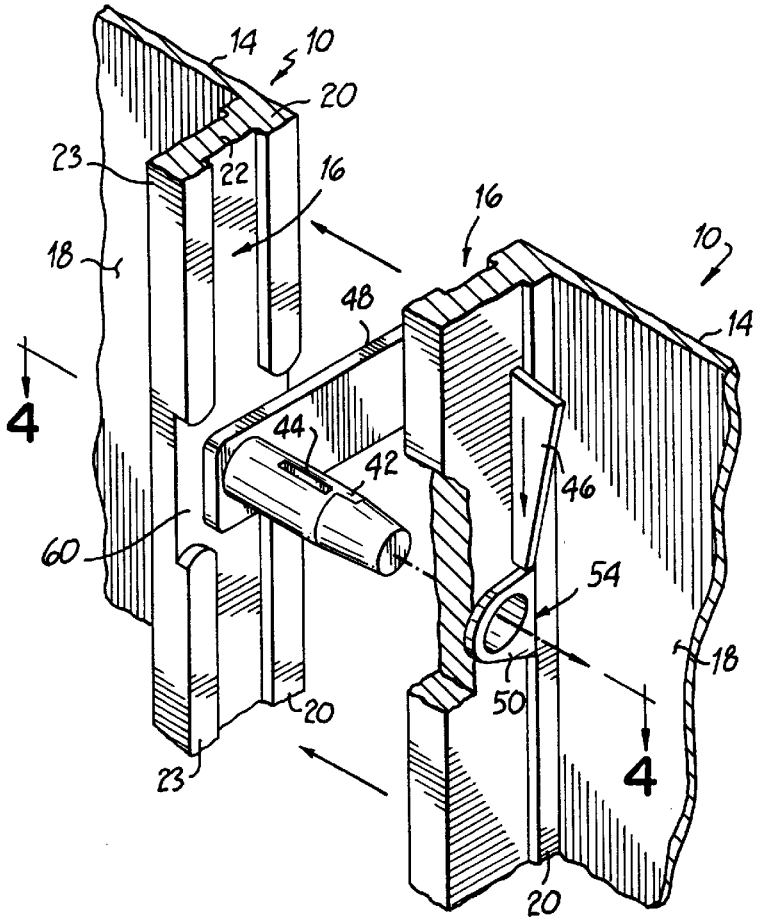
FIG. 3 is an enlarged perspective view of adjacent panels according to this invention being joined together with a pin and wedge.

Referring to FIG. 3, adjacent panels 10 according to this invention are shown being connected together through a mating pin 42 having a slot 44 projecting through the hole 26 in the side flange 16 of the first panel 10. A wedge 46 is inserted through the slot 44 once the side flanges 16 of the panels 10 are juxtaposed to one another. One presently preferred embodiment of the pin and wedge combination for use with this invention is disclosed in U.S. provisional patent applications Ser. No. 60/035,666 filed Jan. 21, 1997 and Ser. No. 60/031,382 filed Nov. 20, 1996, each of which are hereby incorporated by reference in their entirety. A tie 48 is typically mounted onto the pin 42 and a notch 60 is formed in the side flanges 16 to accommodate the tie 48.

Figure 4:
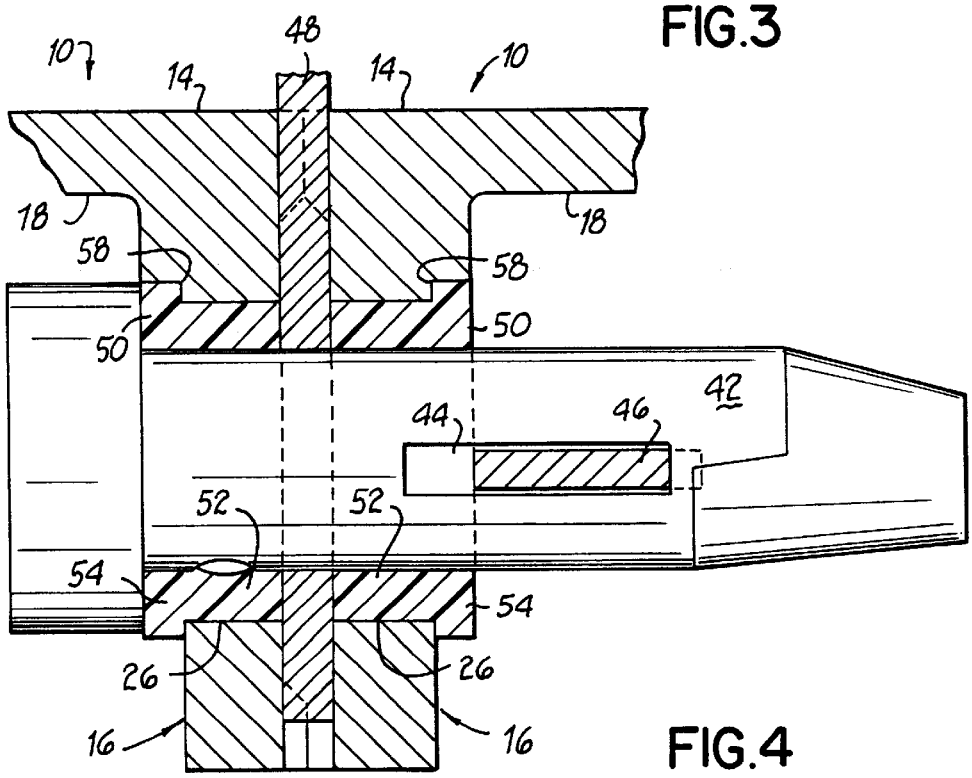
FIG. 4 is a cross-sectional view taken along line 4—4 of FIG. 3 of the flanges of adjacent panels joined together with a pin projecting through bushings according to this invention seated within holes in the flanges of the panels.

Advantageously, a bushing 50 is provided in each of the holes 26 in the side flanges 16 of the panels 10 and the bushing 50 includes a tubular neck 52 seated within the hole 16 and a flared collar 54 which abuts against base 20 on the inner face of the flange 16 (FIGS. 3, 4, 6). The flared collar 54 has a widened flared or tapered base 58 juxtaposed toward the back face of the panel section 12 to provide enhanced load-bearing capabilities in this region. The widened base 58 enhances the load-bearing capability by distributing the load experienced at the juncture between the adjacent panels 10 and the pin 42 across a wider area thereby avoiding a load concentration which may lead to a failure of the various component parts.

From the above disclosure of the general principles of the present invention and the preceding detailed description of a preferred embodiment, those skilled in the art will readily comprehend the various modifications to which this invention is susceptible. Therefore, we desire to be limited only by the scope of the following claims and equivalents thereof.

We claim:

1. A panel for use in constructing a poured concrete wall, the panel having a width and a height and comprising:

a first and a second extruded aluminum panel section each having a generally planar front face and an integrally formed side flange projecting rearwardly from a back face of each panel section, the integrally formed side flange extending longitudinally along an outer side edge thereof and having a height less than the height of the panel, each panel section having a joint member on an inner side edge thereof, a width of each panel section being less than the width of the panel, the panel sections being joined together at the joint members;

a plurality of spaced holes in the side flange of each panel section; and a top flange and a bottom flange along top and bottom edges, respectively, of the joined panel sections, the top and bottom flanges projecting rearwardly from the back faces of the panel sections and extending substantially the full width of the panel.

2. The panel of claim 1 wherein the top and bottom flanges cover the top and bottom edges, respectively, of the joined panel sections as well as a top and a bottom edge of the integrally formed side flanges of the first and second panel sections.

3. A panel for use in constructing a poured concrete wall, the panel having a width and a height and comprising:

a first and a second extruded aluminum panel section each having a generally planar front face and an integrally formed side flange projecting rearwardly from a back face of each panel section, the integrally formed side flange extending longitudinally along an outer side edge thereof, each panel section having a joint member on an inner side edge thereof, a width of each panel section being less than the width of the panel, the panel sections being joined together at the joint members;

a plurality of spaced holes in the side flange of each panel section;

a bushing in each of the holes in the flanges, each bushing having a tubular neck seated within the respective hole and a flared collar having a widened base juxtaposed toward the back face of the panel section to provide enhanced load bearing capability; and a top flange and a bottom flange along top and bottom edges, respectively, of the joined panel sections, the top and bottom flanges projecting rearwardly from the back faces of the panel.

4. The panel of claim 3 wherein the bushing is symmetric relative to a first plane extending perpendicular to the generally planar front face of the respective panel section and asymmetric relative to a second plane extending parallel to the generally planar front face of the respective panel section due to the widened base of the bushing.

5. A panel for use in constructing a poured concrete wall, the panel having a width and a height and comprising:

a first and a second extruded aluminum panel section each having a generally planar front face and an integrally formed side flange projecting rearwardly from a back face of each panel section, the integrally formed side flange extending longitudinally along an outer side edge thereof and having a height less than the height of the panel, each panel section having a joint member on an inner side edge thereof, a width of each panel section being less than the width of the panel, the panel sections being joined together at the joint members;

a plurality of spaced holes in the side flange of each panel section;

a bushing in each of the holes in the flanges, each bushing having a tubular neck seated within the respective hole and a flared collar having a widened base juxtaposed toward the back face of the panel section to provide enhanced load bearing capability; and a top flange and a bottom flange along top and bottom edges, respectively, of the joined panel sections, the top and bottom flanges projecting rearwardly from the back faces of the panel and extending substantially the full width of the panel.

6. A method of making a wall form panel for use in constructing a poured concrete wall, the wall form panel having a width and a height, the method comprising:

extruding a first and a second panel section each having a generally planar front face and an integrally formed side flange projecting rearwardly from a back face of each panel section, the integrally formed side flange extending longitudinally along an outer side edge thereof, each panel section having a joint member on an inner side edge thereof, a width of each panel section being less than the width of the wall form panel;

forming a plurality of spaced holes in the side flange of each panel section;

joining the panel sections together at the joint members of each of the panel sections;

attaching a top flange and a bottom flange along top and bottom edges, respectively, of the joined panel sections, the top and bottom flanges projecting rearwardly from the back faces of the panel sections; and installing a bushing in each of the holes in the flanges, the bushing having a tubular neck seated within the hole and a flared collar having a widened base juxtaposed toward the back face of the panel section to provide enhanced load bearing capability.

7. The method of claim 6 wherein the bushing is symmetric relative to a first plane extending perpendicular to the generally planar front face of the respective panel section and asymmetric relative to a second plane extending parallel to the generally planar front face of the respective panel section due to the widened base of the bushing.

8. A method of making a wall form panel for use in constructing a poured concrete wall, the wall form panel having a width and a height, the method comprising:

extruding from aluminum a first and a second panel section each having a generally planar front face and an integrally formed side flange projecting rearwardly from a back face of each panel section, the integrally formed side flange extending longitudinally along an outer side edge thereof, each panel section having a joint member on an inner side edge thereof, a width of each panel section being less than the width of the wall form panel;

forming a plurality of spaced holes in the side flanges of the first and second panel sections;

installing a bushing in each of the holes in the flanges, the bushing having a tubular neck seated within the hole and a flared collar having a widened base juxtaposed toward the back face of the panel section to provide enhanced load bearing capability;

extruding from aluminum an interior panel section having longitudinal spaced side edges, a generally planar front face and a joint member on each of the longitudinal spaced side edges;

joining the first, second and interior panel sections together with the joint members and with the interior panel section intermediate the first and second panel sections;

adhering a top flange and a bottom flange along top and bottom edges, respectively, of the joined panel sections, the top and bottom flanges projecting rearwardly from the front faces of the panel sections and extending substantially the full width of the panel; and adhering reinforcing members on the back face of the joined panel sections.

9. The method of claim 8 wherein the adhering of the reinforcing members further comprises:

welding a plurality of spaced struts extending laterally on the back face of the panel substantially the width of the panel; and welding a plurality of spaced beams extending longitudinally on the back face of the panel.

10. The method of claim 9 wherein the welding of the spaced beams further comprises welding a plurality of upper beams and lower beams extending longitudinally on the back face of the panel between the uppermost strut and the top flange and between the lowermost strut and the bottom flange, respectively.

11. A method of making a wall form panel for use in constructing a poured concrete wall, the wall form panel having a width and a height, the method comprising:

extruding a first and a second panel section each having a generally planar front face and an integrally formed side flange projecting rearwardly from a back face of each panel section, the integrally formed side flange extending longitudinally along an outer side edge thereof and having a height less than the height of the wall form panel, each panel section having a joint member on an inner side edge thereof, a width of each panel section being less than the width of the wall form panel;

forming a plurality of spaced holes in the side flange of each panel section;

joining the panel sections together at the joint members of each of the panel sections; and attaching a top flange and a bottom flange along top and bottom edges, respectively, of the joined panel sections, the top and bottom flanges projecting rearwardly from the back faces of the panel sections and extending substantially the full width of the panel.

12. The method of claim 11 further comprising:

attaching reinforcing members on the back face of the joined panel sections.

13. The method of claim 12 wherein the attaching of the reinforcing members further comprises:

attaching a plurality of spaced struts extending laterally on the back face of the panel substantially the width of the panel; and attaching a plurality of spaced beams extending longitudinally on the back face of the panel.

14. The method of claim 13 wherein the attaching of the spaced beams further comprises attaching a plurality of upper beams and a plurality of lower beams extending longitudinally on the back face of the panel between the uppermost strut and the top flange and between the lowermost strut and the bottom flange, respectively.

15. The method of claim 14 wherein each of the attaching steps is accomplished by welding and each of the panels are extruded from aluminum.

16. The method of claim 11 wherein the top and bottom flanges are attached to cover the top and bottom edges, respectively, of the joined panel sections as well as a top and a bottom edge of the integrally formed side flanges of the first and second panel sections.

* * * * *